US010167096B2

(12) United States Patent
Luo et al.

(10) Patent No.: US 10,167,096 B2
(45) Date of Patent: Jan. 1, 2019

(54) PACKING MACHINE CORE AND STRAP CUTTING AND IRONING ADHERING METHOD

(71) Applicant: Hangzhou Youngsun Intelligent Equipment Co., Ltd., Xihu Hangzhou, Zhejiang (CN)

(72) Inventors: Bangyi Luo, Zhejiang (CN); Ziquan Zhang, Zhejiang (CN); Caiqin Zhang, Zhejiang (CN); Xiaomin Ding, Zhejiang (CN)

(73) Assignee: HANGZHOU YOUNGSUN INTELLECTUAL EQUIPMENT CO., LTD, Hangzhou, Zhejiang Province (CN)

( * ) Notice: Subject to any disclaimer, the term of this patent is extended or adjusted under 35 U.S.C. 154(b) by 474 days.

(21) Appl. No.: 14/892,133

(22) PCT Filed: Jul. 3, 2013

(86) PCT No.: PCT/CN2013/078741
§ 371 (c)(1),
(2) Date: Nov. 18, 2015

(87) PCT Pub. No.: WO2014/201734
PCT Pub. Date: Dec. 24, 2014

(65) Prior Publication Data

US 2016/0090201 A1 Mar. 31, 2016

(30) Foreign Application Priority Data

Jun. 20, 2013 (CN) ..... 2013 1 0249783
Jun. 20, 2013 (CN) ..... 2013 2 0358131 U

(51) Int. Cl.
*B65B 13/22* (2006.01)
*B65B 13/32* (2006.01)
(Continued)

(52) U.S. Cl.
CPC ..... *B65B 13/32* (2013.01); *B65B 13/06* (2013.01); *B65B 13/22* (2013.01); *B65B 65/02* (2013.01)

(58) Field of Classification Search
CPC ..... B65B 13/32; B65B 65/02; B65B 13/22; B65B 13/06; B65B 13/18; B65B 13/187
See application file for complete search history.

(56) References Cited

U.S. PATENT DOCUMENTS 6,363,689 B1 * 4/2002 Rodriguez ..... B65B 13/06 100/2
6,415,712 B1 * 7/2002 Helland ..... B65B 13/22 100/26
(Continued)

FOREIGN PATENT DOCUMENTS

CN 1620386 5/2005
CN 101765543 6/2010
(Continued)

*Primary Examiner* — Jimmy T Nguyen
(74) *Attorney, Agent, or Firm* — Muncy, Geissler, Olds & Lowe, P.C.

(57) ABSTRACT

A packing machine core and a strap cutting and ironing adhering method, including: a control mechanism, a packing strap ironing adhering and strap catting mechanism, an ironing adhering sliding plate mechanism, and a machine core bracket, where the control mechanism includes a machine core mainshaft and a mainshaft motor. Multiple control cams are mounted on the machine core mainshaft and include multiple cams for controlling the ironing adhering and strap cutting mechanism and a first cam for controlling a swinging arm of the ironing adhering sliding plate mechanism. The mainshaft motor drives, by a speed reducing mechanism, the machine core mainshaft to rotate, and the multiple cams for controlling the ironing adhering and strap cutting mechanism include a left cutter cam, a middle
(Continued)

cutter earn, a right cutter cam, and a second cam for controlling a swinging arm of an ironing head to work.

11 Claims, 8 Drawing Sheets

(51) Int. Cl.
*B65B 65/02* (2006.01)
*B65B 13/06* (2006.01)

(56) References Cited

U.S. PATENT DOCUMENTS

| | | | | |
|---|---|---|---|---|
| 2002/0000078 | A1* | 1/2002 | Shibazaki | B65B 13/32<br>53/582 |
| 2003/0061785 | A1* | 4/2003 | Sakaki | B65B 13/02<br>53/399 |
| 2003/0159409 | A1* | 8/2003 | Oda | B65B 13/22<br>53/589 |

FOREIGN PATENT DOCUMENTS

| | | |
|---|---|---|
| CN | 102530291 | 7/2012 |
| CN | 103086001 | 5/2013 |
| KR | 20130057211 | 5/2013 |

* cited by examiner

PACKING MACHINE CORE AND STRAP CUTTING AND IRONING ADHERING METHOD

FIELD OF THE INVENTION

The invention relates to a machine core of a packing machine and a strap cutting and ironing adhering method thereof.

BACKGROUND OF THE INVENTION

A packing machine is a device for strapping articles by packing straps, the whole packing process includes such steps as strap feeding, strap returning, tightening and ironing adhering, with more movements, and how to implement high-speed packing and guarantee packing quality are keys to reflect a performance of the packing machine.

SUMMARY OF THE INVENTION

A technical problem first to be solved by the invention is to provide a packing machine core, which is reliable in structure, applicable to high-speed packing, and capable of guaranteeing the packing quality. For this purpose, the invention adopts the following technical solution.

A packing machine core, including: a control mechanism, a packing strap ironing adhering and strap cutting mechanism, an ironing adhering sliding plate mechanism, and a machine core bracket, where the control mechanism includes a machine core mainshaft and a mainshaft motor, multiple control cams are mounted on the machine core mainshaft and have multiple cams for controlling the ironing adhering and strap cutting mechanism and a first cam for controlling a swinging arm of the ironing adhering sliding plate mechanism, the mainshaft motor drives, by means of a speed reducing mechanism, the machine core mainshaft to rotate, and the multiple cams for controlling the ironing adhering and strap cutting mechanism include a left cutter cam, a middle cutter cam, a right cutter cam, and a second cam for controlling a swinging arm of an ironing head to work.

The packing strap ironing adhering and strap cutting mechanism is provided with a left cutter, a middle cutter and a right cutter which may move upward or downward, and the machine core bracket is provided with a guide structure for guiding the left cutter, the middle cutter and the right cutter to move upward or downward.

The right cutter has a support head for supporting the packing strap and a hole, positioned underneath the support head of the right cutter, through which the packing strap passes, where a height of the hole is high enough to ensure that when a lower sliding plate is positioned above the middle cutter, the hole can be plugged by a limit slot in the lower sliding plate; the middle cutter has a support head thereof for supporting the packing strap, and a strap cutting fit is formed between an upper margin at a right side of the middle cutter and an upper margin at a left side of the hole mouth; and the left cutter has a support head thereof for supporting the packing strap.

The swinging arm of the ironing adhering sliding plate mechanism and the swinging arm of the ironing head each is respectively positioned at a first side and a second side of the machine core, the left cutter, the middle cutter and the right cutter are positioned between the swinging arm of the ironing adhering sliding plate mechanism and the swinging arm of the ironing head, the first side is either of a front side and a rear side of the machine core, and the second side is either of the front side and the rear side of the machine core.

The ironing adhering sliding plate mechanism includes an upper sliding plate, a lower sliding plate and a sliding guide structure, where a front part of the lower sliding plate is corresponding to the middle cutter, a front part of the upper sliding plate is corresponding to the left cutter, the middle cutter and the right cutter, and the lower sliding plate is connected to a head limit part of a packing strip and a corresponding sensing element; the sliding guide structure includes an upper guide structure for guiding the upper sliding plate to slide and a lower guide structure for guiding the lower sliding plate to slide; the sliding plate mechanism is further provided with a lower sliding plate seat on which the lower sliding plate is mounted, the swinging arm of the ironing adhering sliding plate mechanism is connected to the lower sliding plate seat, the lower sliding plate may slide relatively to the upper sliding plate, and the ironing adhering sliding plate mechanism is provided with a limit structure between the upper sliding plate and the lower sliding plate; an upper packing strip transport gap exists between the front part of the lower sliding plate and the upper sliding plate, the limit part is correspondingly positioned at a left side of the strip transport gap, the front part of the lower sliding plate is provided with a lower packing strip transport limit slot, a mouth of which is open toward a direction of the front part; a retaining part is disposed on the top of a position, on the machine core bracket, where the guide structure for guiding the left cutter, the middle cutter and the right cutter to move upward or downward is disposed, the retaining part is corresponding to the mouth of the limit slot, and the strip transport gap is positioned at the mouth of the limit slot.

The limit structure is configured to limit a movement distance of the lower sliding plate relative to the upper sliding plate, before the lower sliding plate slides backward from a position of an initial state thereof to a middle position, the limit structure does not obstruct the lower sliding plate to slide backward so that the upper sliding plate keeps in a position of an initial state; when the lower sliding plate slides backward from the middle position, the limit structure obstructs the lower sliding plate so that the upper sliding plate is driven to slide backward together with the lower sliding plate to an open state, the middle position is a position where the lower sliding plate is separated from the lower packing strap at the limit slot thereof.

A position of the ironing head in a left and right direction is corresponding to a position between the right cutter and the retaining part.

On the basis of adoption of the technical solution mentioned above, the invention also may further adopt such a technical solution as below.

The machine core bracket is an integral construction, including a rectangular frame body, an upper frame body of which is provided with the guide structure for guiding the left cutter, the middle cutter and the right cutter to move upward or downward, the machine core spindle beneath the upper frame body traverses from the rectangular frame body, the left cutter cam, the middle cutter cam, the right cutter cam, the second cam and the first cam are positioned in the rectangular frame body; and two flanges stretch out from the rectangular frame body to a side where the swing arm of the ironing adhering sliding plate mechanism is, the upper sliding plate and the lower sliding plate slide back and forth between the two flanges, and the sliding chute is disposed at upper ends of the two flanges.

The lower sliding plate seat is provided with a vertical sliding chute connected to the swing arm of the ironing adhering sliding plate mechanism, and the limit structure includes a relative movement limit slot arranged on the lower sliding plate and a limit fitting piece which is connected to a bottom of the upper sliding plate and fits with the relative movement limit slot.

The retaining part is positioned between e left cutter and the middle cutter.

The retaining part may be adjustably mounted fixedly, with a direction of adjustment being a width direction of the limit slot. The upper sliding plate and the lower sliding plate have a retreat groove corresponding to the retaining part.

The guide structures for guiding the left cutter, the middle cutter and the right cutter to move upward or downward each is a guide hole, the left cutter, the middle cutter and the right cutter each has a guide pillar thereof, and each guide pillar is respectively inserted into the respective guide hole and conducts a sliding guide fit The left cutter guide pillar, the middle cutter guide pillar and the right cutter guide pillar each has a mounting hole open downward; the left cutter guide pillar, the middle cutter guide pillar and the right cutter guide pillar are respectively mounted on a respective lifting drive pillar, each lifting drive pillar is respectively inserted into respective corresponding mounting hole, a pressure spring is disposed between each lifting drive pillar and each mounting hole thereof, and a bottom of each lifting drive pillar is provided with a roller fitting with the cam.

The mainshaft motor and the decelerating mechanism are mounted outside one side of the machine core bracket, a multi-functional cam is mounted at an end of the machine core spindle outside the other side of the machine core bracket, the multi-functional cam has three cam surfaces: an inductive cam surface, a packing strap tightening control cam surface and a packing machine frame open-close control cam surface, or an inductive cam surface, a packing strap tightening control cam surface and a strap feeding and returning control cam surface.

Another technical problem to be solved by the invention is to provide a strap cutting and ironing adhering method of the foregoing packing machine core. For this purpose, the invention adopts the following technical solution.

The method provides a strap cutting and ironing adhering initial state, in the initial state, the second cam in the control mechanism controls that the swinging arm of the ironing head is in an open state and the ironing head deviates from above the middle cutter, the first cam controls that the swinging arm of the ironing adhering sliding plate mechanism is in a close state, the lower sliding plate and the upper sliding plate are positioned above the middle cutter, the left cutter cam, the middle cutter cam and the right cutter cam respectively control that the left cutter, the middle cutter and the right cutter are in a low position, and a head of the upper packing strap supports on the head limit part of the strap; and the method includes the following steps:

(1) the controller of the packing machine controls the mainshaft motor to start, and drives the mainshaft to rotate, first of all, the right cutter cam controls the right cutter to rise, to support the upper packing strap by taking the upper sliding plate as a back plate and keep the support state until ironing adhering is completed;

(2) after the packing strap is retreated, the controller of the packing machine controls the mainshaft motor to start and drives the mainshaft to rotate, so that the second cam controls the swinging arm of the ironing head to swing back, the ironing head enters beneath the upper packing strap, also the first cam controls the swinging arm of the ironing adhering sliding plate mechanism to be opened to cause the lower sliding plate to slide backward, in the process when the lower sliding plate slides backward to the middle position, the upper sliding plate keeps in the position of the initial state;

(3) after the packing strap is tightened, the controller of the packing machine controls the mainshaft motor to start, and drives the mainshaft to rotate, so that the left cutter cam controls the left cutter to rise, to support the lower packing strap by taking the upper sliding plate as a back plate and keep the support state until ironing adhering is completed;

(4) the mainshaft motor continues driving the mainshaft to rotate, so that the middle cutter earn controls the middle cutter to rise, fit with the right cutter to cut off the packing strap and adhere to the packing strap;

(5) the mainshaft motor continues driving the mainshaft to rotate, so that the middle cutter cam controls the middle cutter to descend, so that the second cam controls that the swinging arm of the ironing head is opened, and the ironing head deviates from below the upper packing strap and returns to the position of the initial state;

(6) the mainshaft motor continues driving the mainshaft to rotate, so that the middle cutter cam controls the middle cutter to rise, to support the lower packing strap and the upper packing strap by taking the upper sliding plate as a back plate, and to bond the lower packing strap and the upper packing strap;

(7) the mainshaft motor continues driving the mainshaft to rotate, so that the middle cutter cam controls the middle cutter to descend, the left cutter cam controls the left cutter to descend, and the right cutter cam controls the right cutter to descend to the position of the initial state respectively, to cause that the first cam controls the swing arm of the ironing adhering sliding plate mechanism is further opened, and the upper sliding plate is driven to slide back together with the lower sliding plate to deviate from above the left cutter, the middle cutter and the right cutter;

(8) the mainshaft motor drives the mainshaft to rotate, so that the first cam controls the swing arm of the ironing adhering sliding plate mechanism to swing, before strap feeding for a next packing, back to the position of the initial state; and (9) upon the completion of strap feeding, after the head of the upper packing strap supports the strap head limit part, a working cycle is completed, and the controller of the packing machine waits for an instruction for a next packing.

Due to adoption of the technical solution of the invention, the machine core of the invention is simple in an internal structure, reasonable in positions and fit of various structures, easy for control, and capable of ensuring accuracy of a packing strap in the case of high-speed packing. Movement of parts such as sliding plates or the like may adopt a linear sliding as far as possible, thereby improving the speed and reducing interference with other parts and the packing strap. And the machine core bracket uses an integral frame, which is good in integral performance, high in precision, and convenient for assembly. On this basis, the strap cutting and ironing adhering method provided by the invention is compact in motion coherence, high in efficiency, high in packing quality and low in fault rate.

DETAILED DESCRIPTION OF THE EMBODIMENTS

Figure 1:
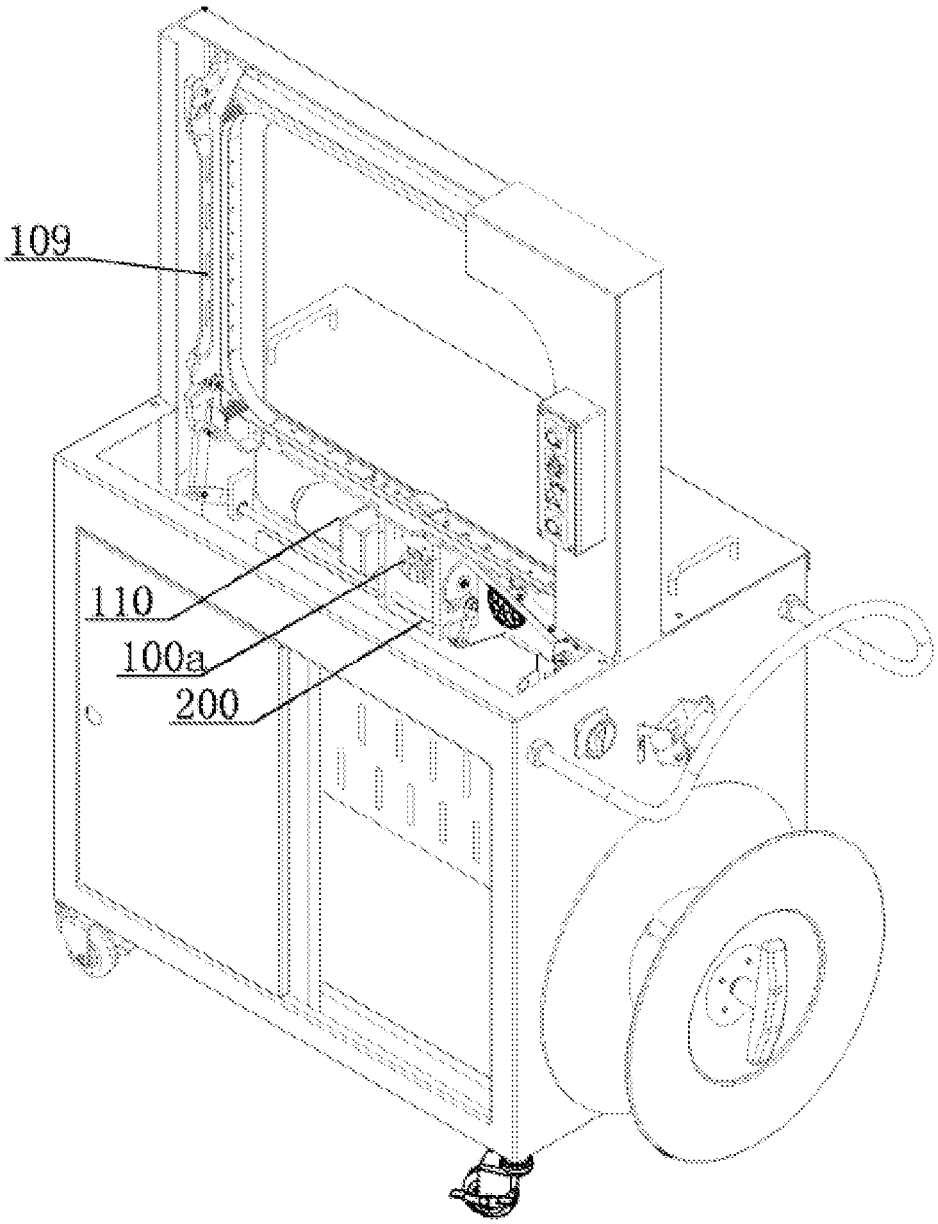
FIG. 1 is a schematic diagram of an application of the machine core provided by the invention to the packing machine.
Figure 2:
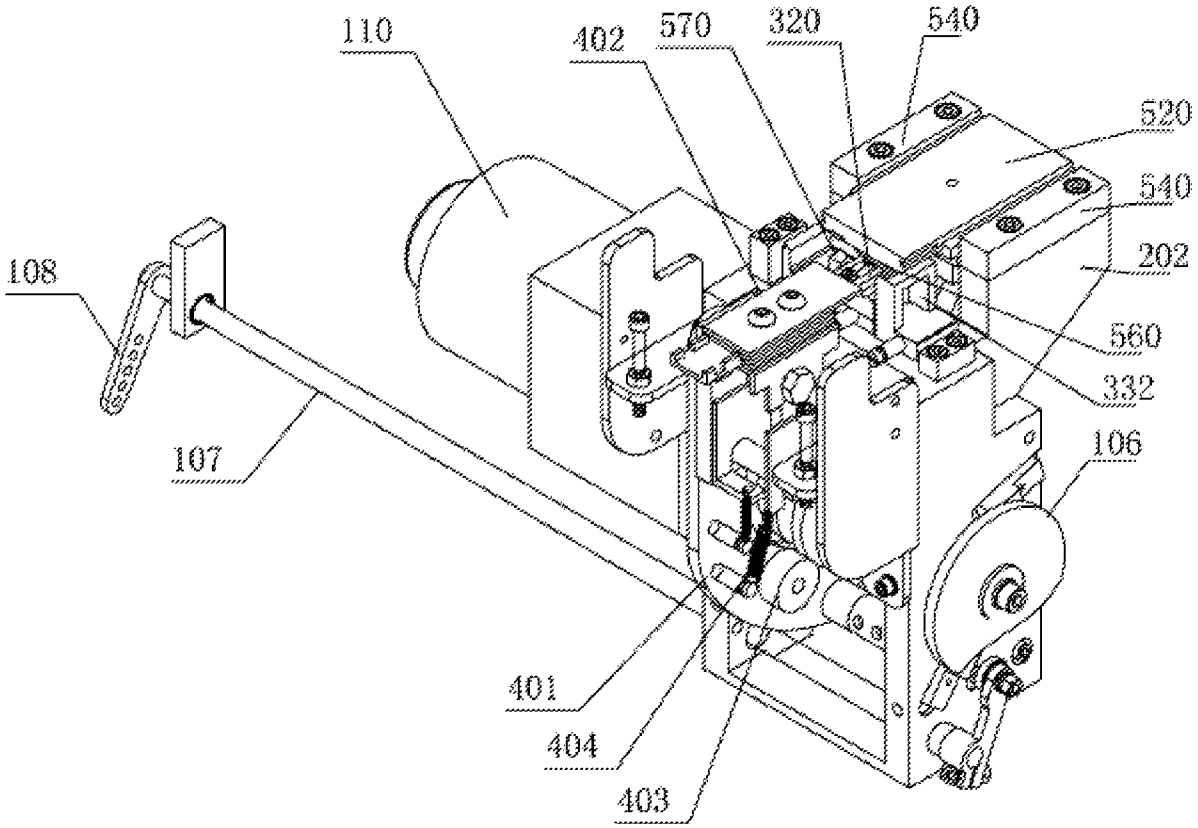
FIG. 2 is a schematic diagram of the machine core according to the invention.
Figure 3:
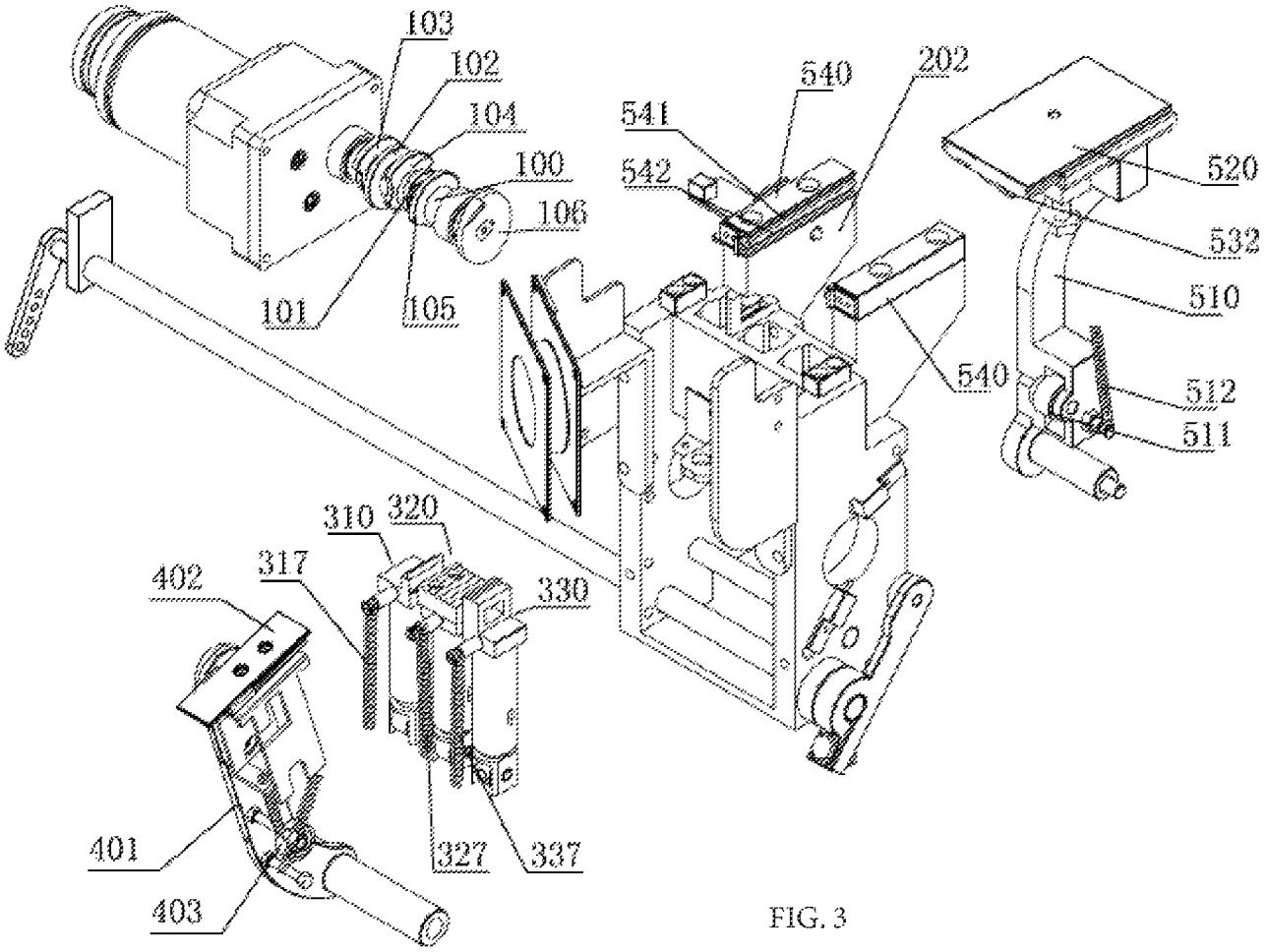
FIG. 3 is an explosive view of the machine core according to the invention.
Figure 4:
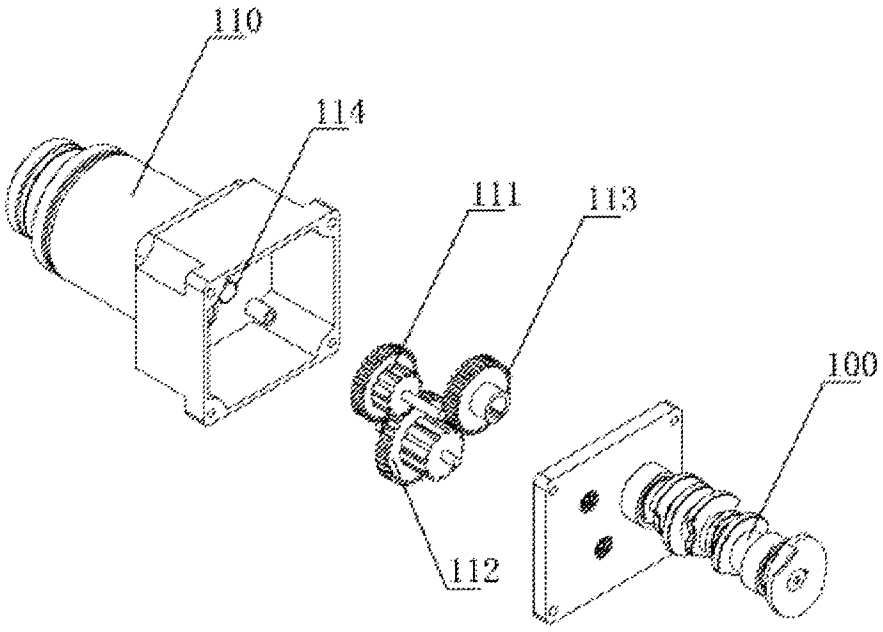
FIG. 4 is an explosive view of the control mechanism and a drive part thereof according to the invention.
Figure 5:
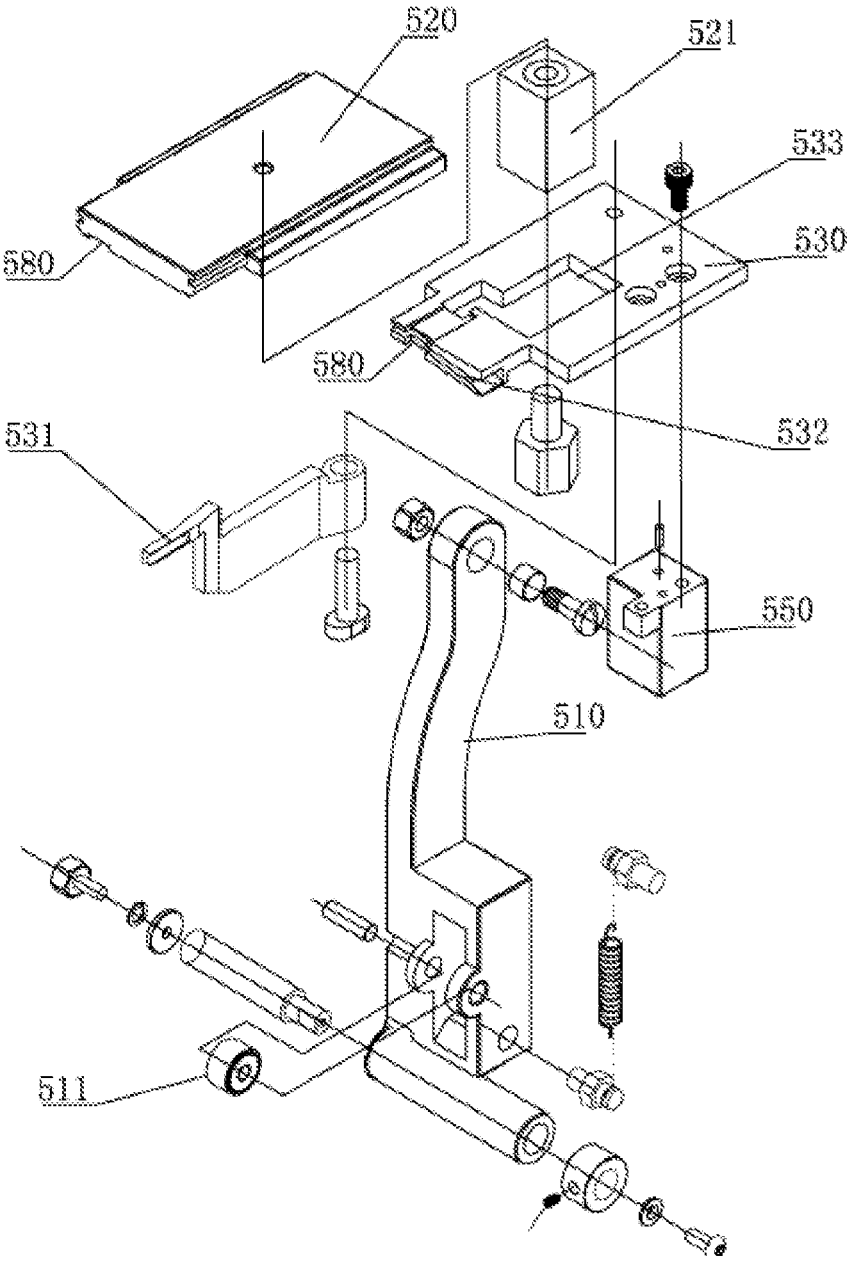
FIG. 5 is an explosive view of the ironing adhering sliding plate mechanism according to the invention.
Figure 6:
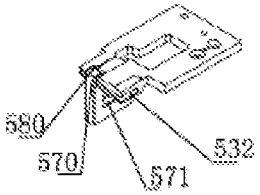
FIG. 6 is a schematic diagram of fit between the lower sliding plate and the retaining part.
Figure 7:
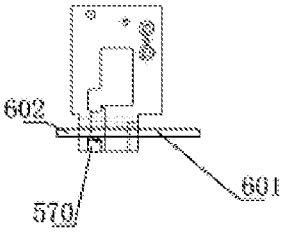
FIG. 7 is a schematic diagram of it among the packing strap, the lower sliding plate and the retaining part.
Figure 10:
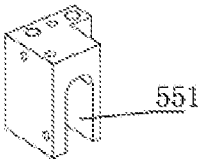
FIG. 10 is a schematic diagram of the lower sliding plate seat.
Figure 8:
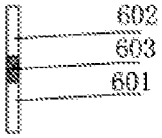
FIG. 8 is a schematic diagram when an ironing adhering connection position of the packing strap is proper.
Figure 9:
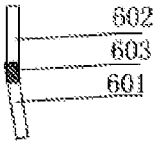
FIG. 9 is a schematic diagram when an ironing adhering connection position of the packing strap is aslant.
Figure 11:
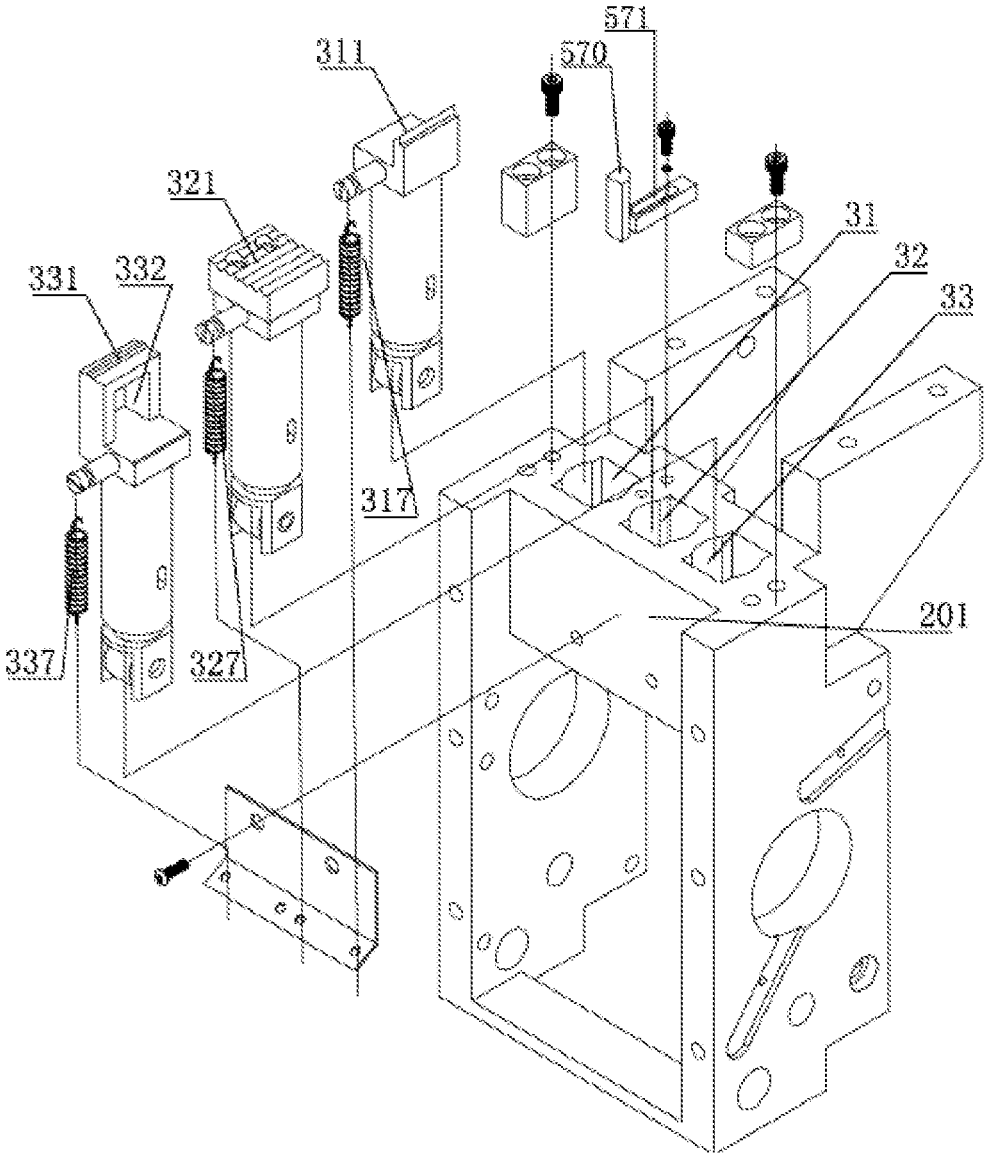
FIG. 11 is an explosive view of the strap cutting mechanism.
Figure 12:
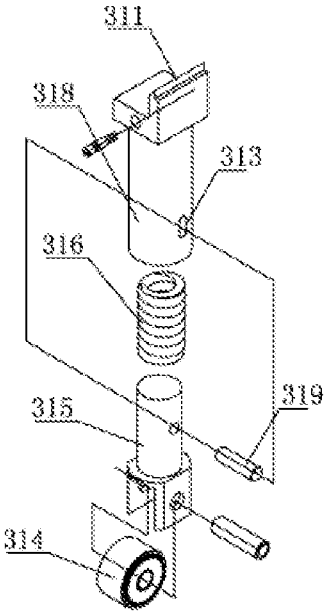
FIG. 12 is an explosive view of the left cutter.
Figure 13:
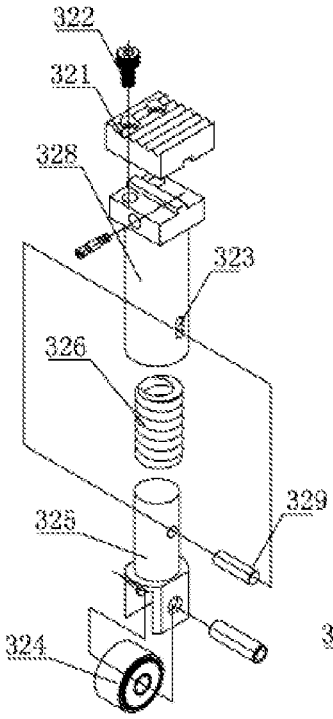
FIG. 13 is an explosive view of the middle cutter.
Figure 14:
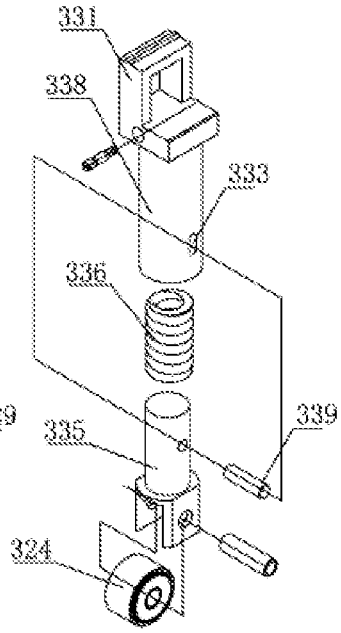
FIG. 14 is an explosive view of the right cutter.

Referring to drawings, the packing machine core provided by the invention, including: a control mechanism, a packing strap ironing adhering and strap cutting mechanism, an ironing adhering sliding plate mechanism, and a machine core bracket 200, where the control mechanism includes a machine core mainshaft 100 and a mainshaft motor 110, multiple control cams are mounted on the machine core mainshaft 100 and include multiple cams for controlling the ironing adhering and strap cutting mechanism and a first cam 101 for controlling a swinging arm 510 of the ironing adhering sliding plate mechanism. The mainshaft motor drives, by means of a speed reducing mechanism, the machine core mainshaft to rotate, and the multiple cams for controlling the ironing adhering and strap cutting mechanism include a left cutter cam 103, a middle cutter cam 104, a right cutter cam 105, and a second cam 102 for controlling a swinging arm 401 of an ironing head to work.

In the invention, the machine core bracket 200 is an integral construction and has a reasonable structure, which can be processed by a numerical control machine, good in integral performance, firm, high in precision, and convenient for installing the machine core and other mechanical structures. The machine core bracket 200 includes a rectangular frame body, an upper frame body 201 of which is provided with the guide structure for guiding the left cutter, the middle cutter and the right cutter to move upward or downward, the machine core spindle 100 beneath the upper frame body 201 traverses from the rectangular frame body, the left cutter cam 103, the middle cutter cam 104, the right positioned cutter cam 105, the second cam 102 and the first cam 101 are in the rectangular frame body (in FIG. 1, these cams positioned in the rectangular frame body uniformly are indicated by 100*a*); and two flanges 202 stretch out from the rectangular frame body to a side where the swing arm 510 of the ironing adhering sliding plate mechanism is, the upper sliding plate 520 and the lower sliding plate 530 slide back and forth between the two flanges 202, and the sliding guide structure thereof is disposed at upper ends of the two flanges 202. In this way, the working reliability and accuracy of the sliding plate mechanism may be further improved.

The mainshaft motor and the decelerating mechanism are mounted outside one side of the machine core bracket, a multi-functional cam 106 is mounted at an end of the machine core spindle outside the other side of the machine core bracket, the multi-functional cam has three cam surfaces: an inductive cam surface, a packing strap tightening control cam surface and a packing machine frame open-close control cam surface, or an inductive cam surface, a packing strap tightening control cam surface and a strap feeding and returning control cam surface. In this embodiment, the multi-functional cam 106 adopts the former structure, drawing reference number 107 indicates a rotating rod, which is controlled by the cam 106 to rotate, drawing reference number 108 indicates a swing arm connected to the rotating rod, which drives a packing machine frame 109 to be open or close.

The decelerating mechanism includes a motor shaft gear 114, a first gear 111, a second gear 112, and a third gear 113; the motor shaft gear 114 and the first gear 111 constitute a first-stage speed reducing gear pair, the first gear 111 and the second gear 112 constitute a second-stage speed reducing gear pair, the second gear 112 and the third gear 113 constitute a third-stage speed reducing gear pair, the first gear 111 has a large gear and a small gear which are coaxial, the second gear 112 also has a large gear and a small gear which are coaxial, the motor shaft gear 114 is engaged with the large gear in the first gear 111, the large gear in the second gear 112 is engaged with the small gear in the first gear 111, the third gear 113 is engaged with the small gear in the second gear 112, and the mainshaft 100 is connected to the third gear 113. The decelerating mechanism is simple in structure and stable in operation, and can ensure the machine core to run smoothly, improve the packing quality and reduce the failure frequency.

The packing strap ironing adhering and strap cutting mechanism is provided with a left cutter 310, a middle cutter 320 and a right cutter 330 which may move upward or downward. The right cutter 330 has a support head 331 for supporting the packing strap and a hole 331, positioned underneath the support head of the right cutter, through which the packing strap passes, where a height of the hole 332 is high enough to ensure that when the lower sliding plate 530 is positioned above the middle cutter, the hole 332 can be plugged by a limit slot 532 in the lower sliding plate; the middle cutter 320 has a support head 321 thereof for supporting the packing strap, and a strap cutting fit is formed between an upper margin at a right side of the middle cutter and an upper margin at a left side of the hole mouth of the right cutter 330; and the left cutter 310 has a support head 311 thereof for supporting the packing strap.

The guide structures for guiding the left cutter, the middle cutter and the right cutter to move upward or downward respectively are a guide hole 31, a guide hole 32 and a guide hole 33, the left cutter, the middle cutter and the right cutter each has a guide pillar 318, a guide pillar 328 and a guide pillar 338, and the guide pillar 318, the guide pillar 328 and the guide pillar 338 are respectively inserted into the guide hole 31 the guide hole 32 and the guide hole 33 and conducts a sliding guide fit.

Upper ends of the left cutter 310, the middle cutter 320 and the right cutter 330 respectively have a connecting piece for connecting their respective reset spring 317, reset spring 327 and reset spring 337.

The left cutter guide pillar 318, the middle cutter guide pillar 328 and the right cutter guide pillar 338 each has a mounting hole open downward.

The left cutter guide pillar 318, the middle cutter guide pillar 328 and the right cutter guide pillar 338 are respectively mounted on their respective lifting drive pillar 315, lifting drive pillar 325 and lifting drive pillar 335, which are respectively inserted into respective corresponding mounting hole, a pressure spring 316, a pressure spring 326 and a pressure spring 336 are respectively disposed between each of the lifting drive pillars 315, 325 and 335 and each mounting hole thereof, and a bottom of each of the lifting drive pillars 315, 325 and 335 is respectively provided with a roller 314, a roller 324 and a roller 334 fitting with the cams, i.e., the left cutter cam 103, the middle cutter cam 104 and the right cutter cam 105.

In this way, after installation it is unnecessary to adjust positions of the left cutter, the middle cutter and the right cutter; therefore, lifting motion of the left cutter, the middle cutter and the right cutter is stable and accurate, with good repeatability.

The mounting hole walls of the left cutter guide pillar 318, the middle cutter guide pillar 328 and the right cutter guide pillar 338 may be respectively provided with a mounting hole 313, a mounting hole 323 and a mounting hole 333; the lifting drive pillar 315, the lifting drive pillar 325 and the lifting drive pillar 335 are respectively provided with a pin 319, a pin 329 and a pin 339 respectively fitting with the mounting hole 313, the mounting hole 323 and the mounting hole 333, so as to prevent the guide pillars from rotating and retreating for a relative movement between the guide pillars and the drive pillars.

The support head 321 of the middle cutter and the middle cutter guide pillar 328 may be split-body parts, so that the support head of the middle cutter may be made from material dedicatedly fitting with ironing adhering and strap cutting, thus improving the performance of the packing machine and reducing the cost. In this case, the support head 321 of the middle cutter and the middle cutter guide pillar 328 may be positioned by using a key slot positioning manner, and fixed by using a screw 322.

An ironing head 402 may use the following structure: including a heating wire, where the heating wire is externally compressed by a stainless steel flat jacket, in the foregoing structure, the stainless steel flat jacket may be conveniently fabricated by squashing a stainless steel pipe, and the stainless steel flat jacket and the heating wire may form a composite structure, which is high in strength, not easy to deformation, and long in service life because of no disadvantage of oxidization of a connecting end. The ironing head 402 is connected to the swinging arm 401 of the ironing head, and the swinging arm 401 of the ironing head is connected to a roller 403 fitting with the second cam 102 and a reset spring 404 of the swinging arm.

The swinging arm 510 of the ironing adhering sliding plate mechanism and the swinging arm 401 of the ironing head in the machine core each is respectively positioned at a first side and a second side of the machine core, the left cutter 310, the middle cutter 320 and the right cutter 330 are positioned between the swinging arm 510 of the ironing adhering sliding plate mechanism and the swinging arm 401 of the ironing head, the first side is either of a front side and a rear side of the machine core, and the second side is either of the front side and the rear side of the machine core. In this way, the ironing head and the sliding plates work in different sides of the packing machine, which is reasonable in structure, convenient for installation, and advantageous to rectilinear translational movement of the mechanism and to dispositions of various protective structures and limit structures. The swinging arm 510 of the ironing adhering sliding plate mechanism is connected to a roller 511 fitting with the first cam 101 and a reset spring 512.

The ironing adhering sliding plate mechanism includes the upper sliding plate 520, the lower sliding plate 530 and a sliding guide structure 540, where the front part of the lower sliding plate 530 is corresponding to the middle cutter 320 so as to keep away from the left cutter 310 and the right cutter 330, the front part of the upper sliding plate 520 is corresponding to the left cutter 310, the middle cutter 320 and the right cutter 330 and serves as the back plate when the left cutter 310, the middle cutter 320 and the right cutter 330 work, the lower sliding plate 530 is connected to a head limit part 531 of a packing strap and a corresponding sensing element, the limit part 531 may be a part rotatably mounted on the lower sliding plate and is provided with a groove corresponding to the head of the packing strap.

The sliding guide structure 540 includes an upper guide structure 541 for a sliding guide of the upper sliding plate and a lower guide structure 542 for a sliding guide of the lower sliding plate, which may respectively use a groove or rail. The sliding plate mechanism is further provided with a lower sliding plate seat 550, on which the lower sliding plate 530 is mounted, the swinging arm 510 of the ironing adhering sliding plate mechanism is connected to the lower sliding plate 530, and the lower sliding plate 530 may slide relatively to the upper sliding plate 520, and the ironing adhering sliding plate mechanism is provided with a limit structure between the upper sliding plate 520 and the lower sliding plate 530.

The lower sliding plate seat is provided with a vertical sliding chute 551 connected to the swinging arm 510 of the ironing adhering sliding plate mechanism.

An upper packing strip transport gap 560 exists between the front part of the lower sliding plate and the upper sliding plate, the limit part 531 is correspondingly positioned at a left side of the strip transport gap 560, the front part of the lower sliding plate 530 is provided with a lower packing strip transport limit slot 532, a mouth of which is open toward a direction of the front part; a retaining part 570 is disposed on the top of a position, on the machine core bracket 200, where the guide structure for guiding the left cutter, the middle cutter and the right cutter to move upward or downward is disposed, the retaining part 570 is corresponding to the mouth of the limit slot 532, and the strip transport gap 530 is positioned at the mouth of the limit slot 532.

The limit structure is configured to limit a movement distance of the lower sliding plate relative to the upper sliding plate, before the lower sliding plate slides backward from a position of an initial state thereof to a middle position, the limit structure does not obstruct the lower sliding plate to slide backward and keep the upper sliding plate in a position of an initial state; when the lower sliding plate slides backward from the middle position, the limit structure obstructs the lower sliding plate so that the upper sliding plate is driven to slide backward together with the lower sliding plate to an open state, the middle position is a position where the lower sliding plate is separated from the lower packing strap at the limit slot thereof.

The limit structure includes a relative movement limit slot 533 arranged on the lower sliding plate 530 and a limit fitting piece 521 which is connected to a bottom of the upper sliding plate 520 and fits with the relative movement limit slot 533.

The retaining part 570 may ensure that a position of an ironing adhering area is in a controllable state when a packing strap is returned, and ensure that during packing a relative state between an upper packing strap 601 and a lower packing strap 602 which are ironed and adhered is not aslant, thereby improving the packing quality. Reference drawing number 603 is an ironing adhering part of the packing strap.

A position of the ironing head 402 in a left and right direction is corresponding to a position between the right cutter 330 and the retaining part 570. The retaining part 570 is mounted between the left cutter 310 and the middle cutter 320.

The retaining part 570 may be adjustably mounted fixedly, with a direction of adjustment being a width direction of the limit slot 532. In this way, the limit slot may adapt to packing straps with different widths, and the position of the retaining part may be optimum. The retaining part 570 is provided with a long mounting hole 571, through which the retaining part is connected to the packing machine core bracket 200 by a screw.

The upper sliding plate and the lower sliding plate have a retreat groove 580 corresponding to the retaining part.

The strap cutting and ironing adhering method of the invention is as below.

The method provides a strap cutting and ironing adhering initial state, in the initial state, the second cam 102 in the control mechanism controls that the swinging arm 401 of the ironing head is in an open state and the ironing head 402 deviates from above the middle cutter 320, the first cam 101 controls that the swinging arm 510 of the ironing adhering sliding plate mechanism is in a close state, the lower sliding plate 530 and the upper sliding plate 520 are positioned above the middle cutter 320, the left cutter cam 103, the middle cutter cam 104 and the right cutter cam 105 respectively control that the left cutter 310, the middle cutter 320 and the right cutter 330 are in a low position, and a head of the upper packing strap 601 supports on the head limit part 531 of the strap; and the method includes the following steps:

(1) a controller of the packing machine controls the mainshaft motor 110 to start, and drives the mainshaft 100 to rotate, first of all, the right cutter cam 105 controls the right cutter 330 to rise, to support the upper packing strap 601 by taking the upper sliding plate 520 as a back plate and keep the support state until ironing adhering is completed; the controller may be a processor having calculation function.

(2) After the packing strap is retreated, the controller of the packing machine controls the mainshaft motor 110 to start and drives the mainshaft 100 to rotate, so that the second cam 102 controls the swinging arm 401 of the ironing head to swing back, the ironing head 402 enters beneath the upper packing strap 601, also the first cam 101 controls the swinging arm 510 of the ironing adhering sliding plate mechanism to be opened to cause the lower sliding plate 530 to slide backward, in the process when the lower sliding plate 530 slides backward to the middle position, the upper sliding plate keeps in the position of the initial state.

(3) After the packing strap is tightened, the controller of the packing machine controls the mainshaft motor to start, and drives the mainshaft to rotate, so that the left cutter cam 103 controls the left cutter 310 to rise, to support the lower packing strap 602 by taking the upper sliding plate 520 as a back plate and keep the support state until ironing adhering is completed.

(4) The mainshaft motor continues driving the mainshaft to rotate, so that the middle cutter 104 cam controls the middle cutter 320 to rise, fit with the right cutter 330 to cut off the packing strap and adhere to the packing strap.

(5) The mainshaft motor continues driving the mainshaft to rotate, so that the middle cutter cam 104 controls the middle cutter 320 to descend, so that the second cam 102 controls that the swinging arm 401 of the ironing head is opened, and the ironing head 402 deviates from below the upper packing strap 601 and returns to the position of the initial state.

(6) The mainshaft motor continues driving the mainshaft to rotate, so that the middle cutter cam 104 controls the middle cutter 102 to rise, to support the lower packing strap 602 and the upper packing strap 601 by taking the upper sliding plate 520 as a back plate, and to bond the lower packing strap 602 and the upper packing strap 601.

(7) The mainshaft motor continues driving the mainshaft to rotate, so that the middle cutter cam 104 controls the middle cutter 320 to descend, the left cutter cam 103 controls the left cutter 310 to descend, and the right cutter cam 105 controls the right cutter 330 to descend to the position of the initial state respectively, to cause that the first cam 101 controls the swing arm 510 of the ironing adhering sliding plate mechanism is further opened, and the upper sliding plate 520 is driven to slide back together with the lower sliding plate 530 to deviate from above the left cutter 310, the middle cutter 320 and the right cutter 330.

(8) The mainshaft motor drives the mainshaft to rotate, so that the first cam 101 controls the swing arm 510 of the ironing adhering sliding plate mechanism to swing, before strap feeding for a next packing, back to the position of the initial state.

(9) Upon the completion of strap feeding, after the head of the upper packing strap 601 supports the strap head limit part 531, a working cycle is completed, and the controller of the packing machine waits for an instruction for a next packing.

The invention claimed is:

1. A packing machine core, comprising: a control mechanism, a packing strap ironing adhering and strap cutting mechanism, an ironing adhering sliding plate mechanism, and a machine core bracket, wherein the control mechanism comprises a machine core mainshaft and a mainshaft motor, multiple control cams are mounted on the machine core mainshaft and are for controlling the ironing adhering and strap cutting mechanism, the multiple control cams including a first cam for controlling a swinging arm of the ironing adhering sliding plate mechanism, a left cutter cam, a middle cutter cam, a right cutter cam, and a second cam for controlling a swinging arm of an ironing head to work, the mainshaft motor drives the machine core mainshaft to rotate;

the packing strap ironing adhering and strap cutting mechanism is provided with a left cutter, a middle cutter and a right cutter, the left cutter, the middle cutter and the right cutter move upward or downward, and the machine core bracket is provided with a guide structure for guiding the left cutter, the middle cutter and the right cutter to move upward or downward;

the right cutter has a support head for supporting the packing strap and a hole, positioned underneath the support head of the right cutter, the packing strap passes through the bole, wherein a height of the hole is high enough to ensure that when a lower sliding plate is positioned above the middle cutter, the hole is pluggable by a limit slot in the lower sliding plate; the middle cutter has a support head thereof for supporting the packing strap, and a strap cutting fit is formed between an upper margin at a right side of the middle cutter and an upper margin at a left side of the hole mouth; and the left cutter has a support head thereof for supporting the packing strap;

the swinging arm of the ironing adhering sliding plate mechanism and the swinging arm of the ironing head each is respectively positioned at a first side and a second side of the machine core, the left cutter, the middle cutter and the right cutter are positioned between the swinging arm of the ironing adhering sliding plate mechanism and the swinging arm of the ironing head, the first side is either of a front side and a rear side of the machine core, and the second side is either of the front side and the rear side of the machine core, the front side and the rear side of the machine core are arranged along an extension direction of the machine core main shaft, the rear side is closer to the mainshaft motor than the front side;

the ironing adhering sliding plate mechanism comprises an upper sliding plate, a lower sliding plate and a sliding guide structure, wherein a front part of the lower sliding plate is corresponding to the middle cutter, a front part of the upper sliding plate is corresponding to the left cutter, the middle cutter and the right cutter, and the lower sliding plate is connected to a head limit part of a packing strip and a corresponding sensing element; the sliding guide structure comprises an upper guide structure for guiding the upper sliding plate to slide and a lower guide structure for guiding the lower sliding plate to slide; the sliding plate mechanism is further provided with a lower sliding plate seat on which the lower sliding plate is mounted, the swinging arm of the ironing adhering sliding plate mechanism is connected to the lower sliding plate seat, the lower sliding plate slides relatively to the upper sliding plate, and the ironing adhering sliding plate mechanism is provided with a limit structure between the upper sliding plate and the lower sliding plate; an upper packing strip transport gap exists between the front part of the lower sliding plate and the upper sliding plate, the limit part is correspondingly positioned at a left side of the strip transport gap, the front part of the lower sliding plate is provided with a lower packing strip transport limit slot, a mouth of which is open toward a direction of the front part; a retaining part is disposed at a position on the machine core bracket, where the guide structure for guiding the left cutter, the middle cutter and the right cutter to move upward or downward is disposed, the retaining part is corresponding to the mouth of the limit slot, and the strip transport gap is positioned at the mouth of the limit slot;

the limit structure comprises a relative movement limit slot arranged on and through the lower sliding plate and a limit fitting piece, the limit fitting piece is connected to a bottom of the upper sliding plate through the relative movement limit slot;

the limit structure is configured to limit a movement distance of the lower sliding plate relative to the upper sliding plate, before the lower sliding plate slides backward from a position of an initial state thereof to a middle position, the limit structure does not obstruct the lower sliding plate to slide backward so that the upper sliding plate keeps in a position of an initial state; when the lower sliding plate slides backward from the middle position, the limit structure obstructs the lower sliding plate so that the upper sliding plate is driven to slide backward together with the lower sliding plate to an open state, the middle position is a position where the lower sliding plate is separated from the lower packing strap at the limit slot thereof; and a position of the ironing head in a left and right direction is corresponding to a position between the right cutter and the retaining part.

2. The packing machine core according to claim 1, wherein the machine core bracket is an integral construction, comprising a rectangular frame body, an upper frame body of which is provided with the guide structure for guiding the left cutter, the middle cutter and the right cutter to move upward or downward, the machine core spindle beneath the upper frame body traverses from the rectangular frame body, the left cutter cam, the middle cutter cam, the right cutter cam, the second cam and the first cam are positioned in the rectangular frame body; and two flanges stretch out from the rectangular frame body to a side where the swing arm of the ironing adhering sliding plate mechanism is, the upper sliding plate and the lower sliding plate slide back and forth between the two flanges, and a sliding chute is disposed at upper ends of the two flanges.

3. The packing machine core according to claim 1, wherein the lower sliding plate seat is provided with a vertical sliding chute connected to the swing arm of the ironing adhering sliding plate mechanism.

4. The packing machine core according to claim 1, wherein the retaining part is mounted between the left cutter and the middle cutter.

5. The packing machine core according to claim 1, wherein the retaining part is adjustably mounted fixedly, with a direction of adjustment being a width direction of the limit slot.

6. The packing machine core according to claim 1, wherein the upper sliding plate and the lower sliding plate have a retreat groove corresponding to the retaining part.

7. The packing machine core according to claim 1, wherein each of the guide structures for guiding the left cutter, the middle cutter and the right cutter to move upward or downward is a guide hole, the left cutter, the middle cutter and the right cutter each has a guide pillar thereof, and each guide pillar is respectively inserted into the respective guide hole and conducts a sliding guide fit.

8. The packing machine core according to claim 7, wherein a left cutter guide pillar, a middle cutter guide pillar and a right cutter guide pillar each has a mounting hole open downward; the left cutter guide pillar, the middle cutter guide pillar and the right cutter guide pillar are respectively mounted on a respective lifting drive pillar, each lifting drive pillar is respectively inserted into respective corresponding mounting hole, a pressure spring is disposed between each lifting drive pillar and each mounting hole thereof, and a bottom of each lifting drive pillar is provided with a roller fitting with the cam.

9. The packing machine core according to claim 2, wherein the mainshaft motor and a decelerating mechanism are mounted outside one side of the machine core bracket, a multi-functional cam is mounted at an end of the machine core spindle outside the other side of the machine core bracket, the multi-functional cam has a set of three cam surfaces: 1) an inductive cam surface, a packing strap tightening control cam surface and a packing machine frame open-close control cam surface, or 2) an inductive cam surface, a packing strap tightening control cam surface and a strap feeding and returning control cam surface.

10. The packing machine core according to claim 4, wherein the retaining part is adjustably mounted fixedly, with a direction of adjustment being a width direction of the limit slot.

11. A strap cutting and ironing adhering method by using the packing machine core of claim 1, wherein the method provides a strap cutting and ironing adhering initial state, in the initial state, the second cam in the control mechanism controls that the swinging arm of the ironing head is in an open state, and the ironing head deviates from above the middle cutter, the first cam controls that the swinging arm of the ironing adhering sliding plate mechanism is in a close state, the lower sliding plate and the upper sliding plate are positioned above the middle cutter, the left cutter cam, the middle cutter cam and the right cutter cam respectively control the left cutter, the middle cutter and the right cutter in a low position, and a head of the upper packing strap supports on the head limit part of the strap, the method comprising:

controlling by a controller of the packing machine core, the mainshaft motor to start, and drives the mainshaft to rotate so that the right cutter cam causes the right cutter to rise, thereby supporting the upper packing strap by taking the upper sliding plate as a back plate and keeping the support state until ironing adhering is completed;

after the packing strap is retreated, controlling, by the controller of the packing machine core, the mainshaft motor to start and drives the mainshaft to rotate, so that the second cam causes the swinging arm of the ironing head to swing back, thereby causing the ironing head to enter beneath the upper packing strap, also that the first cam causes the swinging arm of the ironing adhering sliding plate mechanism to be opened, in the process when the lower sliding plate slides backward to the middle position, and keeping the upper sliding plate in the position of the initial state;

after the packing strap is tightened, controlling, by the controller of the packing machine core, the mainshaft motor to start and drives the mainshaft to rotate, so that the left cutter cam causes the left cutter to rise, thereby supporting the lower packing strap by taking the upper sliding plate as a back plate and keeping the support state until ironing adhering is completed;

further driving the mainshaft motor to rotate the mainshaft, so that the middle cutter cam causes the middle cutter to rise, thereby causing the middle cutter to fit with the right cutter to cut off the packing strap and adhere to the packing strap;

further driving the mainshaft motor to rotate the mainshaft, so that the middle cutter cam causes the middle cutter to descend, so that the second cam causes the swinging arm of the ironing head to open, thereby causing the ironing head to deviate from below the upper packing strap and to return to the position of the initial state;

further driving the mainshaft motor to rotate the mainshaft, so that the middle cutter cam causes the middle cutter to rise, thereby supporting the lower packing strap and the upper packing strap by taking the upper sliding plate as a back plate, and bonding the lower packing strap and the upper packing strap;

further driving the mainshaft motor to rotate the mainshaft, so that the middle cutter cam causes the middle cutter to descend, the left cutter cam causes the left cutter to descend, and the right cutter cam causes the right cutter to descend to the position of the initial state respectively, and so that the first cam causes the swing arm of the ironing adhering sliding plate mechanism to further open, the upper sliding plate being driven to slide back together with the lower sliding plate to deviate from above the left cutter, the middle cutter and the right cutter; and further driving the mainshaft motor to rotate the mainshaft, so that the first cam causes the swing arm of the ironing adhering sliding plate mechanism to swing, before strap feeding for a next packing, back to the position of the initial state; wherein upon the completion of strap feeding, after the head of the upper packing strap supports the strap head limit part, a working cycle is completed, and the controller of the packing machine core waits for an instruction for a next packing.

* * * * *